US006921339B1

(12) United States Patent
Martin et al.

(10) Patent No.: US 6,921,339 B1
(45) Date of Patent: Jul. 26, 2005

(54) ADJUSTABLE SPORTS RAMP SYSTEM

(75) Inventors: James Martin, 9 Haley Ridge Rd., Beacon Falls, CT (US) 06403; Albert Edward Casini, Derby, CT (US)

(73) Assignee: James Martin, Beacon Falls, CT (US)

( * ) Notice: Subject to any disclaimer, the term of this patent is extended or adjusted under 35 U.S.C. 154(b) by 0 days.

(21) Appl. No.: 10/177,507

(22) Filed: Jun. 24, 2002

(51) Int. Cl.[7] ..... A63C 19/10
(52) U.S. Cl. ..... 472/89; 14/69.5
(58) Field of Search ..... 472/88, 89; 14/69.5–72.5

(56) References Cited

U.S. PATENT DOCUMENTS 3,134,999 A * 6/1964 Reynolds ..... 14/71.1
4,123,912 A * 11/1978 Meldrum ..... 405/220
4,285,514 A * 8/1981 Romero ..... 472/89
5,870,788 A * 2/1999 Witkin ..... 14/69.5
6,076,215 A * 6/2000 Blankenship et al. ..... 14/71.1
6,386,819 B1 * 5/2002 Schultz ..... 414/537
6,430,769 B1 * 8/2002 Allen ..... 14/69.5
6,484,343 B1 * 11/2002 Phillips ..... 14/69.5
6,554,748 B2 * 4/2003 Tollner ..... 482/51
6,644,628 B1 * 11/2003 Triche ..... 254/88
6,695,707 B1 * 2/2004 Fernandez et al. ..... 472/89
6,715,177 B1 * 4/2004 Lagergren-Julander ..... 14/69.5

* cited by examiner

*Primary Examiner*—Kien Nguyen
(74) *Attorney, Agent, or Firm*—Our Pal®Asija

(57) ABSTRACT

The PRO-RAMP professional adjustable ramp system of this invention comprises a lower horizontal panel, hinged to a second angularly adjustable panel by a vertical plane. Two embodiments are disclosed. In the preferred embodiment the vertical member is adjusted by concentric tubular members and locking in position by a pair of pins through aligned holes. In the alternate embodiment the inside surfaces of the two panels are notched such that there is no possibility of slippage of the vertical pane and thus of accidental collapse of the plane. A variation of alternate embodiment employs a collapsible truss support instead of the vertical plane. The second horizontal plane may be sectionalized into plurality of planes such that a user can experience different gradients in a single ramp.

3 Claims, 6 Drawing Sheets

ADJUSTABLE SPORTS RAMP SYSTEM

BACKGROUND

Figure 1:
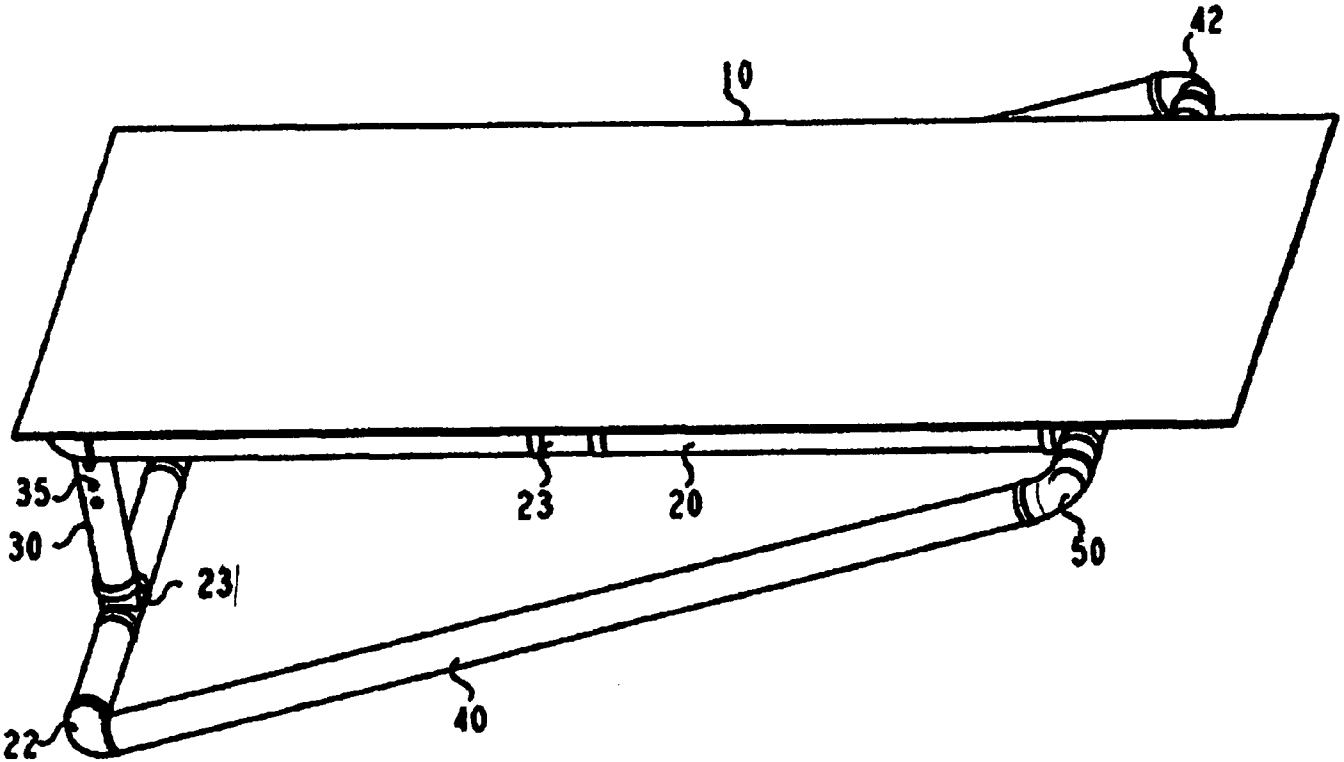

This invention relates generally to the sport of scooters, skateboards in-line skates, bicycles and motorcycles etc. More particularly it relates to an adjustable ramp for kicking a rider of skateboard, scooter etc into the air and jumping down safely to ground.

THE PROBLEM

The problem with prior art ramps for sports enthusiasts is that they are not strong adjustable, portable and cost effective. Prior art sports ramps are not holistic as they do not involve and benefit body mind and spirit of children and adults both indoor and outdoors. Problems with prior art ramps can be categorized into the following:

a) Useable only indoors or outdoors but not both.

b) Challenging to children or adults but not both.

c) Provide benefits for the body or mind but not spirit.

d) Not cost effective.

e) Do not harmonize with the environment.

f) Do not totally engage or involve the users.

g) Educational or entertaining but seldom both.

h) Not strong enough.

i) Not adjustable in height, inclination or contour.

j) Not easily portable, transportable and relocate able.

SUMMARY

The PRO-RAMP professional adjustable ramp system of this invention comprises a lower horizontal panel, hinged to a second angularly adjustable panel by a vertical plane. Two embodiments are disclosed. In the preferred best mode embodiment the vertical member is adjusted by concentric tubular members and locking in position by a pair of pins through aligned holes. In the alternate embodiment the height is adjusted by changing the angle and position of the vertical member and locked in position by notches provided therefore. The inside surfaces of the two planes are notched such that there is no possibility of slippage of the vertical member and thus of accidental collapse of the vertical member. Alternatively instead of the vertical plane a collapsible truss support may be employed or the second horizontal plane may be sectionalized into plurality of planes such that a user can experience different gradients in a single ramp.

This indoor-outdoor sports ramp appeals equally to children, teens and adults. It can be used anywhere! This versatile bundle of fun is the perfect combination of fun and education for all situations! The possibilities for this active sport are limitless.

All of this isn't just fun play. Players develop gross motor skills, visual perceptual skills, and spatial relationships while at the same time learning critical laws of physics and nature. As kids explore the world, they begin to develop these and other skills so necessary in coping with today's contemporary complex society. These activities also keep the users out of mischief, drugs and even crime.

The ramp enhances the port and make it ideal for developing better health, keen mind and strong spirit as well as team spirit among players and family bond and unity, which in turn has positive impact on society by reduced juvenile delinquency and crime.

The ramp closes into a convenient suitcase like carrying case as it includes a latch for holding the two planes adjacent to each other and a convenient handle is also provided for this purpose.

PRIOR ART

A preliminary limited prior art search was not conducted or commissioned by the inventor, as he is intimately familiar with the prior art. The closest prior art known to the applicant is Ramptech Kicker Ramp in CCS mail-order catalog available on the web at www.ccsmailorder.com Unfortunately it is not close enough to the applicant's embodiment.

At any rate it is the applicant's position that none of the prior art devices known to the applicant or his attorney disclose the EXACT embodiment of this inventor that constitutes a simple, elegant, quick, convenient, affordable adjustable cost effective ramp for skateboard, scooter, bicycle and motorcycle enthusiasts.

OBJECTIVES

Unfortunately none of the prior art devices singly or even in combination provide fall of the objectives as established by the inventor for this system as enumerated below.

1. It is an objective of this invention to provide methods, devices and system for playing holistic sports especially involving scooters, skateboards, bicycle and motorcycles etc.

2. Another objective of this invention is to provide an adjustable sports ramp that involves engages and challenges both children and adults, both amateurs and professionals and all levels in between.

3. Another objective of this sports ramp is that it be suitable for playing indoors as well as out doors.

4. Another objective of this game is that it be both educational and entertaining and healthy for body mind and spirit.

5. Another objective of this sports ramp is that it be aesthetic and elegant design that integrates harmoniously with any environment.

6. Another objective of this game is that it involve and benefit body, mind and spirit of all players, users and even spectators.

7. Another objective of this sport is that it promote the expansion of the sports involving ramps.

8. Another objective of this sports ramp is that its use is quick, simple, convenient and easy.

9. Another objective of this invention is that it be suitable for all types of users in all types of weather conditions.

10. Another objective of this invention is that the sports ramp be portable, transportable and easily relocate able.

11. Another objective of this invention is that its design is simple and even elegant.

12. Another objective of this invention is that its use is intuitive which requires no further training.

13. Another objective of the game of this invention is that it he capable of multiple uses.

14. Another objective of this invention is that it use little or no additional energy.

15. Another objective of this invention is that the invention use modular standard components easily interface-able transportable and storable.

16. Another objective of this invention is that it be reliable and sturdy such that it practically never fails and requires little or no maintenance.

17. Another objective of this invention is that it be environmentally friendly and use biodegrade materials to the extent practical.

18. Another objective of this invention is that it be physically safe in normal environment as well as accidental situations.

19. Another objective of this invention is that it be long lasting made from durable material.

20. Another objective of this invention is that it meet all federal, state, local and other private standards guidelines, regulations and recommendations with respect to safety, environment, energy consumption.

21. Another objective of this invention is that it not compromise the safety or the comfort of the users.

22. Another objective of this invention is that it be suitable for gift giving.

23. Another objective of this invention is that it be suitable for promotional give always complete with message of the sponsor such as a union, casino or charitable organization.

24. Another objective of this invention is that it promote family unity and community bond as well as team spirit, unity and bond among unrelated players.

25. Another objective of this invention is that the sports ramp not only be entertaining but capable of teaching and experiencing laws of nature and physics.

26. Another objective of the sports ramp of this invention is that it be adjustable in height, contour and incline.

27. Another objective of this sports ramp is that it be lightweight such that it can be easily carried like a suitcase.

28. Another objective of the sports ramp of this invention is that it not slip.

Other objectives of this invention reside in its simplicity, elegance of design, ease of manufacture, service and use and even aesthetics as will become apparent from the following brief description of the drawings and the detailed description of the concept embodiment.

Unfortunately none of the prior art devices singly or even in combination provide all of the features established by the inventor for this system as enumerated below.

a) Strong, safe and sturdy.

b) Adjustable in height, incline and contour.

c) Multipurpose for scooters, skateboards, bicycle and motorcycle users.

d) A device that can be easily used, stored, repaired and maintained.

Figure 2:
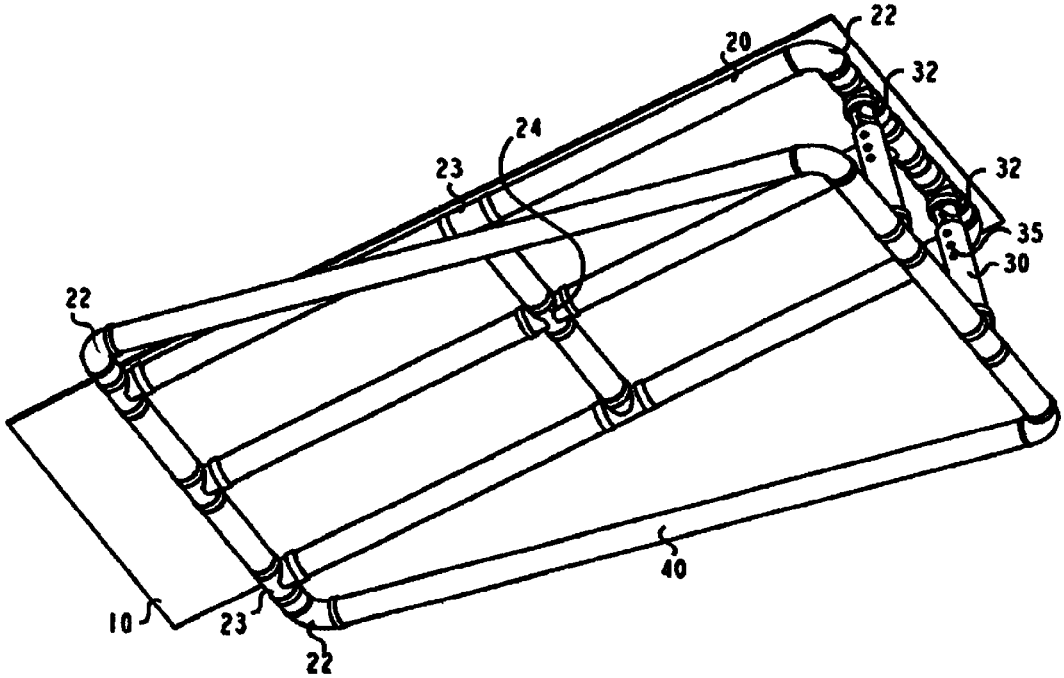
Figure 3:
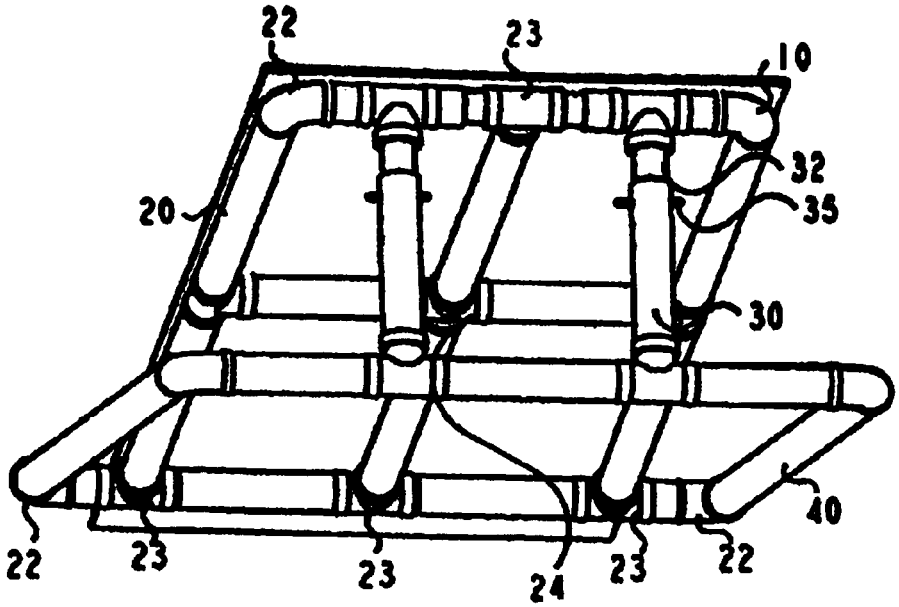
Figure 4:
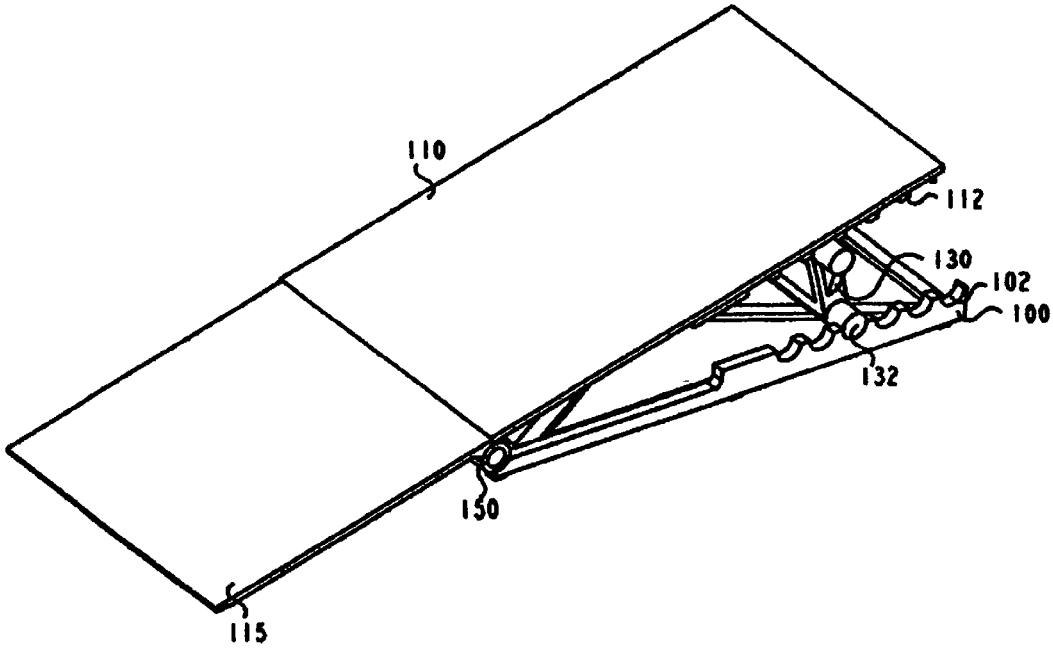
Figure 5:
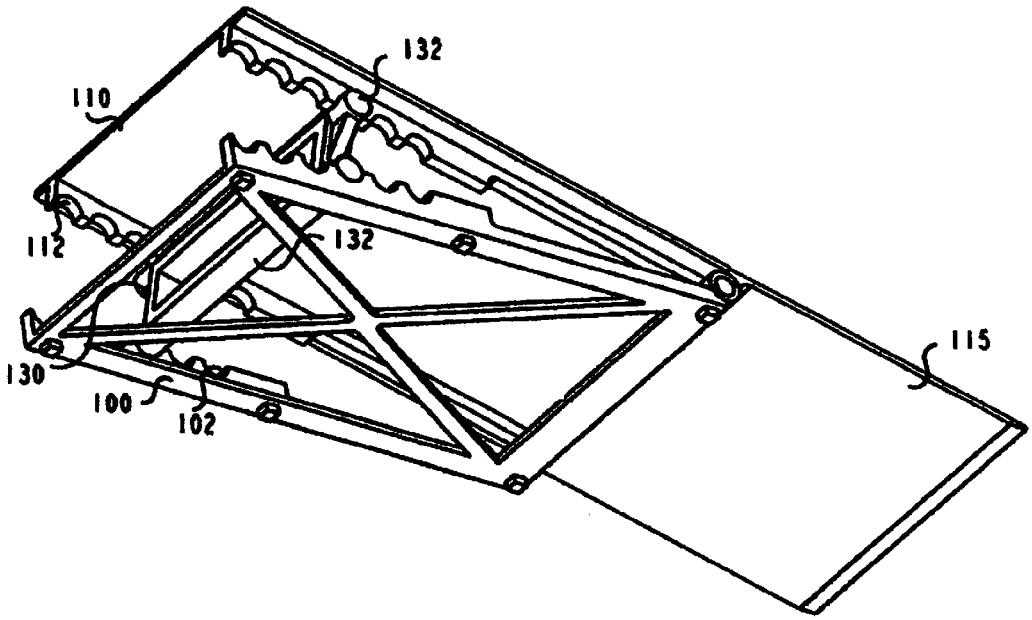
Figure 6:
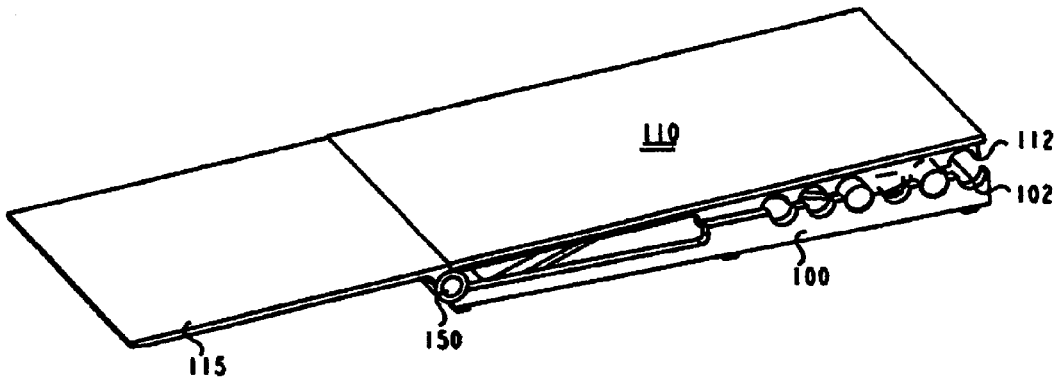

BRIEF DESCRIPTION OF THE DRAWINGS a) FIG. 1 is a 3D side perspective view of the preferred best mode embodiment complete with an inclinable plane and an adjustable height tubular structure with pins and hole arrangement for quickly adjusting the height and inclination.

b) FIG. 2 is a bottom perspective thereof when viewed from the left side.

c) FIG. 3 is another bottom perspective thereof when viewed from the back.

d) FIG. 4 is a perspective 3D side view of the adjustable sports ramp of this invention. Complete with a pair of planes with a fulcrum and vertical support means to achieve multiple inclinations or contours.

e) FIG. 5 shows a perspective bottom view of the adjustable sports ramp.

f) FIG. 6 shows perspective 3D side view of the adjustable sports ramp of this invention in collapsed position such that it can be easily carried like a suitcase.

DETAILED DESCRIPTION OF THE BEST MODE PREFERRED EMBODIMENT

As shown in the drawings wherein like numerals represent like parts throughout the several views, there is generally disclosed in FIG. 1 is a 3D side perspective view of the preferred best mode embodiment complete with an inclinable plane 10 and an adjustable height tubular structure with holes 32 and pins 35 arrangement for quickly adjusting the height and inclination.

FIG. 2 is a bottom perspective of the preferred embodiment when viewed from the left side. The tubular structure in turn comprises a ground plane 40 and ramp plane 20 interconnected by another tubular plane 30, the height of which is adjusted by alignment of holes 32 and inserting a pin 35. The tubular structures are assembled into various shapes by two-way junctions 22, 3-way junctions 23 and 4 way junctions 24 for stability and strength.

FIG. 3 is another bottom perspective thereof when viewed from the back which shows various tubular components and their interface more clearly.

Alternate Embodiment

FIGS. 4–6 show an alternate embodiment wherein FIG. 4 is a perspective 3D side view of the adjustable sports ramp of this invention. Complete with a pair of planes 100, 110 with a fulcrum 150 and vertical support means 130 to achieve multiple inclinations or contours. The planes 100 and 110 each have a plurality of notches 102 on which rests the vertical member 130 with cylindrical interface. An extension of plane 110 is 115 to provide smooth transition from ground to the inclined plane 110. FIG. 5 shows a perspective bottom view of the adjustable sports ramp to show the interface structure more clearly. FIG. 6 shows perspective 3D side view of the adjustable sports ramp of this invention in collapsed position such that it can be easily carried like a suitcase as a convenient handle (Not Shown) is also provided for this purpose.

As can be seen from FIGS. 5 & 6 the two planes are supportable by a vertical plane 130. To make the ramp safe and accidentally collapse proof the inside surfaces of the planes 100 and 110 are lined with saw tooth liners 102 and 112. The entire ramp is also made non-slip on the surface by lining the under surface of the lower panel with non-slip material 110.

FIG. 6 shows an alternate design for a truss support for achieving vertical support complete with lower member 310, upper member 320, a pair of pistons 330 crosses supported by diagonal trusses 340 such that members 310 and 320 can maintain a parallel relationship to each other.

Assembly use and Operation

The sports ramp can be used by individuals or groups of participants from age 5 to 50. It can be played indoors as well as outdoors by amateurs and professional and all skill levels in between. The sport ramp is also known by its potential trademark name of "PRO-RAMP". The objective of the sports utilizing ramp is to have enhanced holistic health, educational and entertaining experiences.

The manufacturing, assembly and use of this invention is very simple even intuitive. Nonetheless the inventor suggests the following procedure for the consumer market.

1. Interconnect at one-end two parallel panels. An optional extension plane may be added for smooth transition from the ground to the ramp. The ground plane may not be solid but hollow rectangular structure but it is mostly a matter of design choice more than any thing else.

2. Add non-slip surface to the underside of the lower panel.

3. Add saw tooth liners to inside surfaces of the panels or in case of the tubular embodiment pin and hole arrangement.

4. Support the panels apart at desired height by one or more vertical panel members or pin and hole arrangement provided for the tubular structure.

5. Enjoy the ramp intuitively for holistic health, entertainment and education.

6. Collapse it into a suitcase and store it for next use.

The inventor has given a non-limiting description of this invention. Due to the simplicity and elegance of the design of this invention designing around it is very difficult if not impossible. Nonetheless many changes may be made to this design without deviating from the spirit of this invention. Examples of such contemplated variations include the following:

1. The shape and size and quantity of the various members and components may be modified.

2. The color, aesthetics and materials may be enhanced or varied.

3. An adjustable high-tension spring may be employed.

4. Additional complimentary and complementary functions and features may be added.

5. A more economical version of the sports ramp be adapted.

6. Portions of the ramp may be curvilinear for added fun.

7. A plurality of vertical support members may be employed.

8. A truss cross support member may be added for extra strength.

9. A latch for closing panels into a suitcase and a handle may be added for carrying convenience.

Other changes such as aesthetics and substitution of newer materials as they become available, which substantially perform the same function in substantially the same manner with substantially the same result without deviating from the spirit of the invention may be made.

Following is a listing of the components used in the best mode preferred embodiment and the alternate embodiments for use with OEM as well as retrofit markets. For the ready reference of the reader the reference numerals have been arranged in ascending numerical order.

| | |
|---|---|
| 10= | Ramp plane of the preferred embodiment |
| 20= | Tubular structure supporting the ramp plane |
| 22= | 2 Way Tubular Junction Interface |
| 23= | 3 Way Tubular Junction Interface |
| 24= | 4 Way Tubular Junction Interface |
| 30= | Vertical Tubular Structure |
| 32= | Straight Holes in Vertical Tubular members |
| 35= | Pins for aligning and locking vertical members in position |
| 40= | Ground Plane tubular structure |
| 42= | Two way Junction interface for the ground plane |
| 50= | Pivotal Interface |
| 100= | Ground plane with notches for the alternate embodiment |
| 102= | Notches on lower ground or base plane |
| 110= | Non-slip liner on the underside of lower panel |
| 112= | Notches on underside of ramp |
| 115= | Extension interface to plane 110 for smooth ground to ramp transition. |
| 130= | Vertical member of the alternate embodiment |
| 132= | Cylindrical interface for the vertical member termination |
| 150= | Fulcrum or hinge between panels |

Definitions and Acronyms

A great care has been taken to use words with their conventional dictionary definitions. Following definitions are included here for clarification.

| | |
|---|---|
| 3D = | Three Dimensional |
| DIY | Do It Yourself |
| Integrated = | Combination of two entities to act like one |
| Interface = | Junction between two dissimilar entities |
| OEM = | Original Equipment Manufacturer |
| Retrofit = | Fitting to an existing arrangement |
| Incline = | A sloping panel with respect to the vertical or horizontal plane |

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefore contemplated that the appended claim(s) cover any such modifications, embodiments as fall within the true scope of this invention.

What is claimed is:

1. A portable height and incline adjustable and collapsible sports ramp system of linear components for unidirectional travel comprising a pair of panels interconnected at one end by a fulcrum; and a vertical support member between said pair of panels wherein said pair of panels comprises a solid ramp panel supported by a first tubular structure and a ground panel comprises a rectangular second tubular structure and wherein said vertical support member comprises an adjustable height tubular structure means with a plurality of pins and holes and wherein the inside surfaces of said pair of planes are lined with saw tooth liners and the underside of said panels is lined with non-slip material and to said ramp system is attached an on ramp entry accessory over said fulcrum of said pair of planes.

2. A portable height and inclination adjustable and collapsible sports ramp system of linear components for unidirectional travel comprising a pair of parallel panels configurable in open and closed position, a tubular support member between said parallel panels; and a handle connected to said pair of parallel panels in closed position and wherein height and inclination of said panels in open position are adjusted by a tubular pin and hole arrangement and wherein height and inclination of said panels in open position are adjusted by a vertical member with horizontal tubular cylindrical interface and matching interface to inside surfaces of said pair of panels in open position and further to said ramp system is attached an on ramp truss support member and a plane extension member as a means for smooth ground to ramp plane transition for entry at low end and exit at higher level at the opposite end of said sports ramp by the user.

3. The height and inclination adjustable sports ramp system for unidirectional travel of claim 2 wherein said truss support member comprises:

a) a lower member;

b) an upper member positioned above said lower member;

c) a pair of pistons between said lower member and said upper member; and d) a pair of diagonal trusses interconnecting said pair of pistons.

* * * * *